US005607894A

United States Patent [19]

Akutsu et al.

[11] Patent Number: 5,607,894

[45] Date of Patent: Mar. 4, 1997

[54] HEAT-SENSITIVE RECORDING MATERIAL

[75] Inventors: Mitsuo Akutsu; Nobuhide Tominaga; Keiji Oya; Athuo Tomita; Kouichi Shigeno, all of Saitama-ken, Japan

[73] Assignee: Asahi Denka Kogyo Kabushiki Kaisha, Tokyo, Japan

[21] Appl. No.: 487,847

[22] Filed: Jun. 7, 1995

[30] Foreign Application Priority Data

Jun. 13, 1994 [JP] Japan ..... 6-129977

[51] Int. Cl.[6] ..... B41M 5/30

[52] U.S. Cl. ..... 503/209; 427/150; 503/208; 503/216

[58] Field of Search ..... 503/208, 209, 503/216, 225; 427/150

[56] References Cited

FOREIGN PATENT DOCUMENTS

| | | | |
|---|---|---|---|
| 0343014 | 11/1989 | European Pat. Off. | 503/208 |
| 58-049294 | 3/1983 | Japan | 503/216 |
| 59-140096 | 8/1984 | Japan | 503/216 |
| 3-045385 | 2/1991 | Japan | 503/209 |
| 4-164687 | 6/1992 | Japan | 503/216 |
| WO90/00047 | 1/1990 | WIPO | 8/405 |

OTHER PUBLICATIONS

N. Tominaga, "Development of high resistance developer for direct thermal paper", Chemical Abstracts, Feb. 5, 1996, vol. 124, No. 6, Abstract No. 71391t, pp. 1170–1171.

*Primary Examiner*—Bruce H. Hess
*Attorney, Agent, or Firm*—Young & Thompson

[57] ABSTRACT

The heat-sensitive recording material of the present invention comprises a heat-sensitive recording layer containing at least one resorcylic anilide derivative represented by the following general formula:

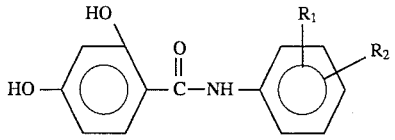

(I)

wherein $R_1$ represents an alkyl or alkoxy, group having 1 to 4 carbon atoms and $R_2$ represents a hydrogen atom or an alkyl or alkoxy group having 1 to 4 carbon atoms.

7 Claims, No Drawings

HEAT-SENSITIVE RECORDING MATERIAL

BACKGROUND OF THE INVENTION

1. Field of the Invention

The present invention relates to a heat-sensitive recording material improved in storage stability. In particular, the present invention relates to a heat-sensitive recording material having a heat-sensitive recording layer containing a specified resorcylic anilide derivative added thereto to thereby not only ensure excellent coloring sensitivity but also improve the resistance to heat, light and oil during storage.

2. Description of Related Art

Heat-sensitive recording materials are produced by applying a usually colorless or light-colored coupling substance and a developer which colors the coupling substance upon being heated together with a sensitizer, a binder and other additives to the surface of a support such as paper, synthetic paper, plastic film or sheet. When a heating element such as a thermal head or hot pen is brought into contact with the recording material in a recording device, the coupling substance reacts with the developer to develop a color such as black, thereby forming a record. The above recording materials (heat-sensitive recording materials) are widely used not only in copying books and documents but also in instrumental recorders, computers, facsimiles, telex devices, automatic passenger ticket vending machines, prepaid cards, labels, etc., because they are superior to other recording materials in that time-consuming treatments such as development and fixing can be dispensed with, the records can be obtained in a short time with the use of a relatively simple apparatus, the noise and the environmental pollution are only slight, and they are inexpensive.

With respect to the conventional heat-sensitive recording materials, those practically satisfactory from the viewpoint of initial coloring sensitivity and stain of non-image areas (fogging of non-image areas) are obtained by an appropriate combination of a coupling substance (leuco dye), a developer which effects thermal coloring of the coupling substance, and an optionally employed sensitizer.

However, when the above heat-sensitive recording materials are exposed to sunlight or illuminating rays for a prolonged period of time, a drawback occurs such that the printed area (colored area) fades or vanishes while the non-image area discolors (yellows). When a printout from a facsimile, a word processor or a personal computer is allowed to stand still on a desk, the recorded image becomes unclear, thereby causing a problem on document storage.

Further, the conventional heat-sensitive recording materials have drawbacks in that not only is the light resistance poor but also the storage stability is lowered when they are stored under severe conditions, for example, at high temperatures, when fingerprints are impressed thereon or when the recording material is brought into contact with oils such as a plasticizer migrated from, for example, a desk mat made of polyvinyl chloride or the like. Therefore, there has been a strong demand for the improvement of the stability of the heat-sensitive recording material during storage.

Among the above developers, it is known that hydroxybenzoic amide compounds have relatively high storage stability. For example, additions of salicylicamide compounds for improving the coloring sensitivity, the resistance of colored images to plasticizers and the stability of non-image areas on the recording material have been proposed in, for example, Japanese Patent Laid-Open Nos. 11036/1978, 49294/1983 and 140096/1984. Despite the use of such compounds, however, the stabilities of the recording materials during storage have been still unsatisfactory and have been unable to satisfy the practical requirements at all.

Japanese Patent Laid-Open No. 209590/1983 proposes to use a developer comprising a resorcylic acid derivative having two hydroxyl groups, described examples thereof including a resorcylic anilide. Although this anilide achieves a significant improvement in the stability of colored images as compared with the salicylicamide compound, it has a drawback in that the fogging of non-image areas on the recording material is intense and especially intense after the storage of the recording material. Therefore, the resorcylic anilide is unsatisfactory from the viewpoint of practical applications.

SUMMARY OF THE INVENTION

Therefore, an object of the present invention is to provide a heat-sensitive recording material which causes less fading in the colored area and also less discoloration in the non-image area of the recording material even after storage under severe conditions, thus having excellent storage stability.

The inventors have made intensive studies to find out that this object can be attained by a heat-sensitive recording material having a heat-sensitive recording layer containing a specified resorcylic anilide derivative.

The present invention has been made on the basis of the above finding and provides a heat-sensitive recording material comprising a heat-sensitive recording layer containing at least one resorcylic anilide derivative represented by the following general formula:

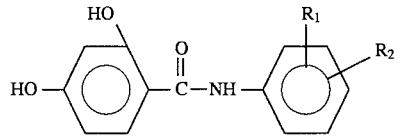

(I)

wherein $R_1$ represents an alkyl or alkoxy group having 1 to 4 carbon atoms and $R_2$ represents a hydrogen atom or an alkyl or alkoxy group having 1 to 4 carbon atoms.

The heat-sensitive recording material of the present invention causes less fading-in the colored area and also less discoloration in the non-image area of the recording material even after storage under severe conditions, thus having excellent storage stability, because it contains a specified resorcylic anilide derivative.

DETAILED DESCRIPTION OF THE INVENTION

The resorcylic anilide derivative for use in the present invention is a component employed for improving the stability of the heat-sensitive recording material of the present invention during storage and also a component which itself has developing capability and possesses the function of a developer.

With respect to the resorcylic anilide derivative for use in the present invention, each of the alkyl groups represented by $R_1$ and $R_2$ of the above general formula (I) and having 1 to 4 carbon atoms includes, for example, methyl, ethyl, propyl, isopropyl, butyl, sec-butyl, tert-butyl and isobutyl, and each of the alkoxy groups represented by $R_1$ and $R_2$ of the above general formula (I) and having 1 to 4 carbon atoms includes, for example, those derived from the above alkyl groups. Although the positions of the above substituents $R_1$ and $R_2$ at which these are bonded to the benzene ring are not particularly limited, a compound in which $R_1$ is bonded at an ortho position relative to the amino group is preferred from the viewpoint of a high effect achieved thereby.

Therefore, the following compounds (Compound Nos. 1 to 7) can be mentioned as representative examples of the above resorcylic anilide derivatives represented by the general formula (I):

Compound No. 1:

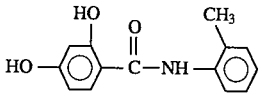

Compound No. 2:

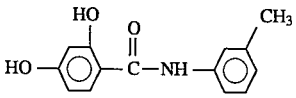

Compound No. 3:

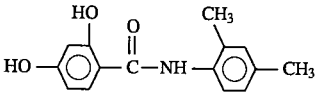

Compound No. 4:

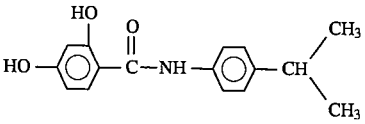

Compound No. 5:

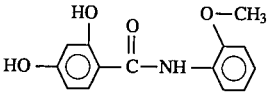

Compound No. 6:

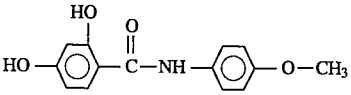

Compound No. 7:

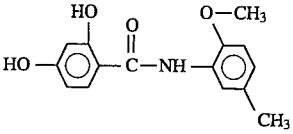

The process for producing the resorcylic anilide derivative of the above general formula (I) is not particularly limited, and the resorcylic anilide derivative can easily be produced, for example, by reacting phenyl resorcylate with an aniline derivative.

SYNTHETIC EXAMPLE

Synthetic examples for obtaining the above resorcylic anilide derivative of the general formula (I) for use in the present invention will now be described, which by no means limit the invention.

Synthetic Example 1
(synthesis of Compound No. 1)

23.0 g (0.10 mol) of phenyl resorcylate and 15.9 g (0.15 mol) of 2-methylaniline were dissolved in 50 g of diglyme and reacted at 170° C. for 5 hr in a nitrogen atmosphere. The solvent was removed from the resultant reaction mixture under reduced pressure. 50 g of toluene were added to the residue and heated, thereby obtaining a solution. The solution was slowly cooled to thereby effect crystallization, and the obtained crystals were collected by filtration and dried to thereby obtain 21.3 g of a white powder having a melting point of 99° C. The obtained white powder was confirmed to be the desired Compound No. 1.

Synthetic Examples 2 to 7
(syntheses of Compound Nos. 2 to 7)

Various compounds were synthesized from starting compounds different from that of Synthetic Example 1 in the same manner as in Synthetic Example 1. The melting points of the obtained compounds were measured, by which the compounds were confirmed to be the desired Compound Nos. 2 to 7. The respective melting points of the obtained compounds were as follows:

Compound No. 2: 204° C.,

Compound No. 3: 164° C.,

Compound No. 4: 172° C.,

Compound No. 5: 166° C.,

Compound No. 6: 204° C., and

Compound No. 7: 156° C.

Although the content of the resorcylic anilide derivative represented by the general formula (I) varies depending on the demanded performance, suitability for the recording, and the kinds and amounts of the dyes (coupling dyes), which will be described below, and other additives such as another developer and a sensitizer employed in combination therewith and hence is not particularly limited, it generally ranges from 0.01 to 10 parts by weight, preferably from 0.1 to 5 parts by weight per part by weight of the coupling dye. When the above content is less than 0.01 part by weight per part by weight of the coupling dye, the effect of the resorcylic anilide derivative on the improvement of the stability of the recording material during storage is poor. On the other hand, even if the resorcylic anilide derivative is used in an amount greater than 10 parts by weight, the above effect is no longer enhanced and leads to the waste thereof.

The heat-sensitive recording material of the present invention comprises a heat-sensitive recording layer and a support. The heat-sensitive recording layer contains at least one resorcylic anilide derivative represented by the above general formula (I). The heat-sensitive recording layer is formed from the resorcylic anilide derivative of the above general formula (I) and a coupling substance optionally together with a developer, a sensitizer of varied type, a customary storage stabilizer, etc., added thereto.

The above coupling substances are generally colorless or light-colored, and various dyes (coupling dyes) are used as the coupling substances. The dyes are not particularly limited so far as they are usually used for producing ordinary heat-sensitive recording materials such as heat-sensitive recording paper.

Examples of the coupling dyes include:

(1) triarylmethane compounds such as 3,3-bis-(p-dimethylaminophenyl)-6-dimethylaminophthalide, 3-(p-dimethylaminophenyl)-3-(2-phenyl-3-indolyl)phthalide, 3-(p-dimethylaminophenyl)-3-(1,2-dimethyl-3-indolyl)phthalide, 3,3-bis(9-ethyl-3-carbazolyl)-5-dimethylaminophthalide and 3,3-bis(2-phenyl-3-indolyl)-5-dimethylaminophthalide;

(2) diphenylmethane compounds such as 4,4-bis(dimethylamino)benzhydryl benzyl ether and N-2,4,5-trichlorophenylleucoauramine;

(3) xanthene compounds such as Rhodamine-β-anilinolactam, 3-(N-methyl-N-cyclohexylamino)-6-methyl-7-anilinofluoran, 3-diethylamino-7-octylaminofluoran, 3-diethylamino-7-(2-chloroanilino)fluoran, 3-diethylamino-6-methyl-7-anilinofluoran, 3-diethylamino-6-methyl-7-(2,4-dimethylanilino)fluoran, 3-diethylamino-7-dibenzylaminofluoran, 3-diethylamino-6-chloro-7-(β-ethoxyethylamino)fluoran, 3-diethylamino-6-chloro-7-(γ-chloropropylamino)fluoran, 3-(N-ethyl-N-isoamylamino)-6-methyl-7-anilinofluoran, 3-(N-ethyl-N-ethoxyethylamino)-6-methyl-7-anilinofluoran, 3-(N-ethyl-N-tetrahydrofurfurylamino)-6-methyl-7-anilinofluoran, 3-(N-ethyl-N-tolylamino)-6-methyl-7-anilinofluoran, 3-dibutylamino-6-methyl-7-anilinofluoran, 3-dibutylamino-7-(2-chloroanilino)fluoran, 3-dipentylamino-6-methyl-7-anilinofluoran, 3-piperidino-6-methyl-7-anilinofluoran and 3-(4-anilino)anilino-6-methyl-7-chlorofluoran;

(4) thiazine compounds such as benzoyl leuco methylene blue and p-nitrobenzoyl leuco methylene blue;

(5) spiro compounds such as 3-methylspirodinaphthopyran, 3-ethylspirodinaphthopyran, 3-benzylspirodinaphthopyran and 3-methylnaphtho-(3-methoxybenzo)spiropyran; and (6) other compounds such as 3,5',6-tris-(dimethylamino)-spiro[9H-fluorene-9,1'(3'H)isobenzofuran]-3'-one and 1,1-bis[2-(4-dimethylaminophenyl)-2-(4-methoxyphenyl)ethenyl]-4,5,6,7-tetrachloro-(3H)isobenzofuran]-3-one. These dyes can be used either individually or as a mixture of two or more thereof.

As mentioned above, the resorcylic anilide derivative of the general formula (I) for use in the present invention itself exerts an effect as a developer, so that it is unnecessary to use other developers. However, when the coloring sensitivity of the recording material is further to be increased, any of conventional developers such as phenols, organic carboxylic acids and metal salts can be used in combination therewith. The content of the resorcylic anilide derivative for use in the present invention can be reduced by the use of the above other developers in combination. Further, the above resorcylic anilide derivative for use in the present invention is highly effective in improving the stability of the recording material during storage, so that, even when the other developers are used in large quantity, the stability of the recording material during storage can be improved.

Examples of the above other developers include phenols such as p-octylphenol, p-tert-butylphenol, p-phenylphenol, p-hydroxyacetophenone, α-naphthol, β-naphthol, p-tert-octylcatechol, 2,2'-dihydroxybiphenyl, bisphenol A, 1,1-bis(p-hydroxyphenyl)butane, 2,2-bis(4-hydroxyphenyl)heptane, 2,2-bis(3-methyl-4-hydroxyphenyl)propane, 2,2-bis(3,5-dimethyl-4-hydroxyphenyl)propane, 2,2-bis(3,5-dichloro-4-hydroxyphenyl)propane, bis(4-hydroxyphenyl) sulfone, bis(3-allyl-4-hydroxyphenyl) sulfone, bis(3,4-dihydroxyphenyl) sulfone, 2,4'-dihydroxyphenyl sulfone, 1,1-bis(4-hydroxyphenyl)cyclohexane, bis(4-hydroxyphenyl) ether, bis[2-(4-hydroxyphenylthio)ethoxy]methane, 4-(4-isopropoxybenzenesulfonyl)phenol, dimethyl 4-hydroxyphthalate, butyl bis(4-hydroxyphenyl)acetate, benzyl p-hydroxybenzoate and 3,5-di-tert-butylsalicylic acid; organic-carboxylic acids such as benzoic acid; and metal salts such as zinc salicylate. Of these, phenol developers are preferably employed.

The above other developers are used each in an amount generally ranging from 0.1 to 10 parts by weight, preferably from 0.2 to 5 parts by weight per part by weight of the coupling dye. When the above amount is less than 0.1 part by weight per part by weight of the coupling dye, the coloring sensitivity of the recording material is poor. On the other hand, even if the other developers are used each in an amount greater than 10 parts by weight, this effect is no longer enhanced and leads to the waste thereof.

Various sensitizers can be added to the heat-sensitive recording material of the present invention in order to further enhance the coloring sensitivity of the recording material. Examples of the sensitizers include metal salts of organic acids such as zinc acetate, zinc octylate, zinc laurate, zinc stearate, zinc oleate, zinc behenate, zinc benzoate, zinc dodecylsalicylate, calcium stearate, magnesium stearate and aluminum stearate; amide compounds such as stearamide, stearic methylolamide, stearoylurea, acetanilide, acetotoluidide, acetoacetic anilide, acetoacetic 2-methylanilide, acetoacetic 2-chloroanilide, acetoacetic 2-methoxyanilide, acetoacetic 4-methylanilide, acetoacetic 2,4-dimethylanilide, benzoic stearylamide, ethylenebisstearamide and hexamethylenebisoctylamide; and 1,2-bis(3,4-dimethylphenyl)ethane, m-terphenyl, 1,2-diphenoxyethane, 1,2-bis(3-methylphenoxy)ethane, p-benzylbiphenyl, p-benzyloxybiphenyl, diphenyl carbonate, bis(4-methylphenyl) carbonate, dibenzyl oxalate, bis(4-methylbenzyl) oxalate, phenyl 1-hydroxy-2-naphthalenecarboxylate, benzyl 1-hydroxy-2-naphthalenecarboxylate, phenyl 3-hydroxy-2-naphthalenecarboxylate, methylene dibenzoate, 1,4-bis(2-vinyloxyethoxy)benzene, 2-benzyloxynaphthalene, benzyl 4-benzyloxybenzoate, dimethyl phthalate, dibenzyl terephthalate, dibenzoylmethane and 4-methylphenoxy-p-biphenyl. These sensitizers are generally used each in an amount of 0.1 to 10 parts by weight per part by weight of the coupling dye.

When the heat-sensitive recording material of the present invention must have an especially high storage stability, any of other storage stabilizers can be used according to necessity in combination with the above resorcylic anilide derivative represented by the general formula (I).

Examples of such other storage stabilizers include hindered phenol compounds such as 1,1,3-tris(2-methyl-4-hydroxy-5-tert-butylphenyl)butane, 1,1,3-tris(2-methyl-4-hydroxy-5-cyclohexylphenyl)butane, 4,4'-butylidenebis(2-tert-butyl-5-methylphenol), 4,4'-thiobis(2-tert-butyl-5-methylphenol), 2,2'-thiobis(6-tert-butyl-4-methylphenol) and 2,2'-methylenebis(6-tert-butyl-4-methylphenol); and 4-benzyloxy-4'-(2-methylglycidyl oxy)biphenyl sulfone and sodium 2,2'-methylenebis(4,6-di-tert-butylphenyl) phosphate. These storage stabilizers are generally used each in an amount of 0.1 to 10 parts by weight per part by weight of the coupling dye.

The heat-sensitive recording material of the present invention can be obtained, for example, in the following manner.

The resorcylic anilide derivative of the general formula (I) for use in the present invention and the coupling dye (colorless coupling dye) optionally together with the other developer, the sensitizer and the other storage stabilizer are usually finely ground with a grinding machine such as a ball mill, an attritor or a sand grinder or with a suitable emulsifier. Further, various additives as required are added, thereby obtaining a coating fluid. The coating fluid is applied to paper or any of various films, so that the desired heat-sensitive recording material of the present invention can be obtained.

The above coating fluid usually contains a binder such as polyvinyl alcohol, hydroxyethylcellulose, methylcellulose, polyvinylpyrrolidone, polyacrylamide, starch, styrene/maleic anhydride copolymer, vinyl acetate/maleic anhydride copolymer, styrene/butadiene copolymer or a modification of any of them and a filler such as kaolin, silica, diatomaceous earth, talc, titanium dioxide, calcium carbonate, magnesium carbonate, aluminum hydroxide or melamine. Further, a metallic soap, an amide, a wax, a light stabilizer, a waterproofing agent, a dispersant, an antifoaming agent and the like can be added to the coating fluid according to necessity.

The heat-sensitive recording material of the present invention can be used in facsimile paper, printer paper, labels, price tags, tickets and other various applications in which conventional heat-sensitive recording materials are used.

The present invention will be described in greater detail with reference to the following Examples and Comparative Examples. The Examples, however, by no means limit the invention.

EXAMPLE 1

20 g of 3-(N,N-dibutylamino)-6-methyl-7-anilinofluoran and 100 g of a 10% aqueous polyvinyl alcohol solution were sufficiently milled by means of a ball mill, thereby obtaining a dispersion A.

20 g of each sample compound (specified in Table 1 below) and 100 g of a 10% aqueous polyvinyl alcohol solution were sufficiently milled by means of a ball mill, thereby obtaining a dispersion B.

20 g of 1,2-bis(3,4-dimethylphenyl)ethane and 100 g of a 10% aqueous polyvinyl alcohol solution were sufficiently milled by means of a ball mill, thereby obtaining a dispersion C.

The dispersions A, B and C were mixed together in a weight ratio of 1:2:2. 50 g of calcium carbonate was added to 200 g of the liquid mixture and sufficiently dispersed therein, thereby obtaining a coating fluid. This coating fluid was applied to a paper support of 50 g/m$^2$ in basis weight to form a layer having a thickness of 32 μm, which was dried to thereby obtain a heat-sensitive recording material.

Printing was effected on the obtained heat-sensitive recording material by the use of a thermal printer (TH-PMD manufactured by Ohkura Electric Co., Ltd.) with its pulse width being fixed at 0.8 msec. The color density of the recorded image (printed area) and the density of the non-image area (initial density) were measured by the use of a Macbeth densitometer (model RD-933 manufactured by Macbeth Co.).

Then the colored heat-sensitive recording material was held at 60° C. under a dry condition for 24 hr, and the densities of the printed and non-image areas were measured to thereby evaluate the resistance to heat during storage.

Further, the colored heat-sensitive recording material was placed in a carbon arc fadeometer and irradiated for 6 hr. Thereafter, the densities of the printed and non-image areas were measured to thereby evaluate the resistance to light during storage. In the measurement of the density of the non-image area, use was made of a yellow filter.

Still further, the colored heat-sensitive recording material was stamped with dioctyl phthalate and held at 40° C. under a dry condition for 24 hr. Thereafter, the densities of the printed and non-image areas were measured to thereby evaluate the resistance to oil during storage. The results are given in Table 1 below.

TABLE 1

| | | | | Storage stability | | |
|---|---|---|---|---|---|---|
| No. | Sample compd. | Density | Initial density | resistance to heat | resistance to light | resistance to oil |
| Comp. Ex. 1-1 | comp. compd. 1*[1] | printed area | 1.30 | 0.53 | 0.91 | 0.31 |
| | | non-image area | 0.07 | 0.09 | 0.11 | 0.09 |
| 1-2 | comp. compd. 2*[2] | printed area | 1.34 | 1.12 | 1.10 | 0.95 |
| | | non-image area | 0.12 | 0.18 | 0.15 | 0.16 |
| 1-3 | comp. compd. 3*[3] | printed area | 1.40 | 1.25 | 1.22 | 1.13 |
| | | non-image area | 0.07 | 0.12 | 0.16 | 0.15 |
| Example 1-1 | compd. No. 1 | printed area | 1.43 | 1.40 | 1.31 | 1.41 |
| | | non-image area | 0.05 | 0.07 | 0.09 | 0.07 |
| 1-2 | compd. No. 2 | printed area | 1.41 | 1.34 | 1.29 | 1.35 |
| | | non-image area | 0.06 | 0.08 | 0.09 | 0.08 |
| 1-3 | compd. No. 3 | printed area | 1.40 | 1.35 | 1.30 | 1.32 |
| | | non-image area | 0.06 | 0.08 | 0.10 | 0.10 |
| 1-4 | compd. No. 4 | printed area | 1.46 | 1.41 | 1.32 | 1.39 |
| | | non-image area | 0.05 | 0.06 | 0.09 | 0.09 |
| 1-5 | compd. No. 5 | printed area | 1.46 | 1.43 | 1.32 | 1.44 |
| | | non-image area | 0.05 | 0.06 | 0.08 | 0.07 |
| 1-6 | compd. No. 6 | printed area | 1.41 | 1.36 | 1.30 | 1.38 |
| | | non-image area | 0.06 | 0.08 | 0.10 | 0.09 |
| 1-7 | compd. No. 7 | printed area | 1.45 | 1.41 | 1.31 | 1.42 |
| | | non-image area | 0.05 | 0.06 | 0.08 | 0.08 |

*[1]comparative compound 1

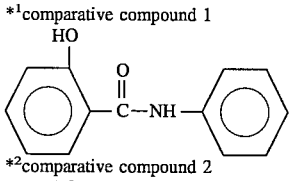

*[2]comparative compound 2

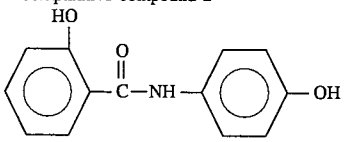

TABLE 1-continued

| No. | Sample compd. | Density | Initial density | Storage stability resistance to heat | resistance to light | resistance to oil |
|---|---|---|---|---|---|---|

*3comparative compound 3

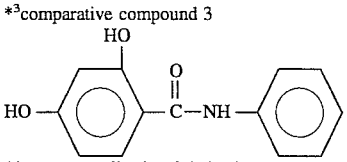

(the same applies hereinbelow)

EXAMPLE 2

20 g of 3-(N-ethyl-N-isoamylamino)-6-methyl-7-anilinofluoran and 100 g of a 10% aqueous polyvinyl alcohol solution were sufficiently milled by means of a ball mill, thereby obtaining a dispersion A.

20 g of bisphenol A and 100 g of a 10% aqueous polyvinyl alcohol solution were sufficiently milled by means of a ball mill, thereby obtaining a dispersion B.

20 g of 2-benzyloxynaphthalene and 100 g of a 10% aqueous polyvinyl alcohol solution were sufficiently milled by means of a ball mill, thereby obtaining a dispersion C.

20 g of each sample compound (specified in Table below) and 100 g of a 10% aqueous polyvinyl alcohol solution were sufficiently milled by means of a ball mill, thereby obtaining a dispersion D.

The dispersions A, B, C and D were mixed together in a weight ratio of 1:2:2:0.5 and sufficiently dispersed, thereby obtaining a coating fluid. This coating fluid was applied to a paper support of 50 g/m$^2$ in basis weight to form a layer having a thickness of 32 μm, which was dried to thereby obtain a heat-sensitive recording material.

The obtained heat-sensitive recording material was evaluated in the same manner as in Example 1. The results are given in Table 2 below.

EXAMPLE 3

20 g of 3-(N,N-dibutylamino)-6-methyl-7-anilinofluoran and 100 g of a 10% aqueous polyvinyl alcohol solution were sufficiently milled by means of a ball mill, thereby obtaining a dispersion A.

20 g of resorcylic acid 2-methoxyanilide (compound No. 5) and 100 g of a 10% aqueous polyvinyl alcohol solution were sufficiently milled by means of a ball mill, thereby obtaining a dispersion B.

20 g of each sample compound (specified in Table 3 below) and 100 g of a 10% aqueous polyvinyl alcohol solution were sufficiently milled by means of a ball mill, thereby obtaining a dispersion C.

The dispersions A, B and C were mixed together in a weight ratio of 1:2:2. 50 g of calcium carbonate was added to 200 g of the liquid mixture and sufficiently dispersed therein, thereby obtaining a coating fluid. This coating fluid was applied to a paper support of 50 g/m$^2$ in basis weight to form a layer having a thickness of 32 μm, which was dried to thereby obtain a heat-sensitive recording material.

Printing was effected on the obtained heat-sensitive recording material by the use of a thermal printer (TH-PMD manufactured by Ohkura Electric Co., Ltd.) with its pulse width being fixed at 0.8 msec. The color density of the recorded image (printed area) and the density of the non-image-area (initial density) were measured by the use of a

TABLE 2

| No. | | Sample compd. | Density | Initial density | Storage stability resistance to heat | resistance to light | resistance to oil |
|---|---|---|---|---|---|---|---|
| Comp. Ex. | 2-1 | comp. compd. 3 | printed area | 1.34 | 0.95 | 1.13 | 0.84 |
| | | | non-image area | 0.08 | 0.11 | 0.16 | 0.14 |
| | 2-2 | bisphenol A | printed area | 1.30 | 0.88 | 1.12 | 0.70 |
| | | | non-image area | 0.09 | 0.11 | 0.13 | 0.10 |
| Example | 2-1 | compd. No. 1 | printed area | 1.35 | 1.18 | 1.23 | 1.13 |
| | | | non-image area | 0.07 | 0.09 | 0.11 | 0.08 |
| | 2-2 | compd. No. 2 | printed area | 1.34 | 1.15 | 1.20 | 1.10 |
| | | | non-image area | 0.07 | 0.10 | 0.12 | 0.09 |
| | 2-3 | compd. No. 3 | Printed area | 1.36 | 1.19 | 1.22 | 1.13 |
| | | | non-image area | 0.07 | 0.09 | 0.11 | 0.08 |
| | 2-4 | compd. No. 4 | printed area | 1.34 | 1.13 | 1.18 | 1.08 |
| | | | non-image area | 0.08 | 0.11 | 0.12 | 1.10 |
| | 2-5 | compd. No. 5 | printed area | 1.37 | 1.20 | 1.25 | 1.17 |
| | | | non-image area | 0.07 | 0.09 | 0.10 | 0.08 |
| | 2-6 | compd. No. 6 | printed area | 1.34 | 1.16 | 1.19 | 1.12 |
| | | | non-image area | 0.08 | 0.11 | 0.11 | 0.09 |
| | 2-7 | compd. No. 7 | printed area | 1.36 | 1.20 | 1.24 | 1.15 |
| | | | non-image area | 0.07 | 0.09 | 0.11 | 0.08 |

Macbeth densitometer (model RD-933 manufactured by Macbeth Co.).

Then the colored heat-sensitive recording material was held at 60° C. under a dry condition for 24 hr, and the densities of the printed and non-image areas were measured to thereby evaluate the resistance to heat during storage.

Further, the colored heat-sensitive recording material was placed in a carbon arc fadeometer and irradiated for 6 hr. Thereafter, the densities of the printed and non-image areas were measured to thereby evaluate the resistance to light during storage. In the measurement of the density of the non-image area, use was made of a yellow filter.

Still further, the colored heat-sensitive recording material was stamped with dioctyl phthalate and held at 40° C. under a dry condition for 24 hr. Thereafter, the densities of the printed and non-image areas were measured to thereby evaluate the resistance to oil during storage.

The results are given in Table 3 below.

TABLE 3

| | | | | | Storage stability | | |
|---|---|---|---|---|---|---|---|
| | No. | Sample compd. | Density | Initial density | resistance to heat | resistance to light | resistance to oil |
| Example | 3-1 | acetoacetic acid 4-methylanilide | printed area | 1.48 | 1.45 | 1.36 | 1.46 |
| | | | non-image area | 0.05 | 0.06 | 0.07 | 0.07 |
| | 3-2 | acetoacetic acid 4-methylanilide | printed area | 1.47 | 1.44 | 1.35 | 1.44 |
| | | | non-image area | 0.05 | 0.07 | 0.07 | 0.07 |
| | 3-3 | acetoacetic acid 2-chloroanilide | printed area | 1.46 | 1.44 | 1.33 | 1.44 |
| | | | non-image area | 0.05 | 0.06 | 0.08 | 0.07 |
| | 3-4 | acetoacetic acid 2,4-dimethylanilide | printed area | 1.46 | 1.43 | 1.32 | 1.44 |
| | | | non-image area | 0.05 | 0.07 | 0.08 | 0.07 |

The results of the above Tables 1, 2 and 3 demonstrate the following.

The heat-sensitive recording materials (Comparative Examples 1-1 and 1-2) having heat-sensitive recording layers containing salicylicamide compounds (comparative compounds 1 and 2) were poor in storage stability and exhibited marked fading of the colored area in the tests of resistance to heat, light and oil during storage, although their initial color densities were relatively excellent. Further, the heat-sensitive recording materials (Comparative Examples 1-3 and 2-1) having heat-sensitive recording layers containing resorcylic anilide derivative other than those of the general formula (I) (comparative compound 3) were poor in the stability of the non-image area during storage and exhibited marked fogging of the non-image area after the storage test, although their initial color densities and colored area stabilities during storage were relatively excellent.

In contrast, the heat-sensitive recording materials (Examples 1-1 to 1-7, 2-1 to 2-7 and 3-1 to 3-4) having the resorcylic anilide derivatives of the general formula (I) (compound Nos. 1 to 7) incorporated therein not only had excellent initial color densities but also were excellent in the storage stability and exhibited only extremely slight fading of the colored area and fogging of the non-image area even in the storage tests.

Moreover, the resorcylic anilide derivative of the general formula (I) according to the present invention not only functions as a developer having excellent storage stability when no other developer is used but also has the effect of improving the stability of the other developer during storage when it is incorporated, thus being useful as a storage stabilizer having developing capability.

What is claimed is:

1. A heat-sensitive recording material comprising a heat-sensitive recording layer and a support, said heat-sensitive recording layer containing at least one resorcylic anilide derivative and a colorless or light-colored coupling dye, said resorcylic anilide derivative being represented by the following general formula:

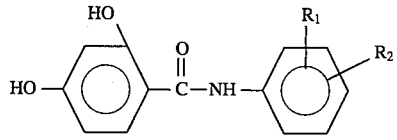

(I)

wherein $R_1$ represents an alkyl or alkoxy group having 1 to 4 carbon atoms and $R_2$ represents a hydrogen atom or an alkyl or alkoxy group having 1 to 4 carbon atoms.

2. A heat-sensitive recording material according to claim 1, wherein the resorcylic anilide derivative is a compound represented by the general formula (I) in which $R_1$ is an alkoxy group.

3. A heat-sensitive recording material according to claim 1, wherein the resorcylic anilide derivative is resorcylic 2-methoxyanilide.

4. A heat-sensitive recording material according to claim 1, wherein the heat-sensitive recording layer further contains a sensitizer.

5. A heat-sensitive recording material according to claim 4, wherein the sensitizer is a hydrocarbon compound having an aromatic ring.

6. A heat-sensitive recording material according to claim 4, wherein the sensitizer is a hydrocarbon compound having an ether bond and an aromatic ring.

7. A heat-sensitive recording material according to claim 4, wherein the sensitizer is an acetoacetic anilide compound.

* * * * *